United States Patent [19]

Richey

[11] 4,131,167

[45] Dec. 26, 1978

[54] RELEASABLE DRILL STRING STABILIZER

[76] Inventor: Vernon T. Richey, 1111 Blalock, Apartment 160, Houston, Tex. 77055

[21] Appl. No.: 821,570

[22] Filed: Aug. 3, 1977

Related U.S. Application Data

[63] Continuation-in-part of Ser. No. 677,929, Apr. 19, 1976, abandoned.

[51] Int. Cl.[2] ..... E21B 17/00

[52] U.S. Cl. ..... 175/323; 308/4 A; 403/203; 403/229; 403/109; 403/221

[58] Field of Search ..... 175/323, 325; 308/4 A; 64/27 C, 27 CT; 403/104–109, 203, 221, 229, 291; 192/106.2; 279/23 R, 23 A

[56] References Cited

U.S. PATENT DOCUMENTS

| | | | |
|---|---|---|---|
| 976,232 | 11/1910 | Tyson | 64/27 CT |
| 2,166,937 | 7/1939 | Bettis | 175/323 X |
| 2,352,412 | 6/1944 | Sandstone | 175/323 X |
| 2,438,637 | 3/1948 | Jansen | 175/323 X |
| 2,671,641 | 3/1954 | Hinkle | 308/4 A |
| 2,907,189 | 10/1959 | Flieg | 64/27 CT X |
| 2,936,625 | 5/1960 | Heiseler | 64/27 CT X |
| 3,967,831 | 7/1976 | Chang et al. | 403/229 |

*Primary Examiner*—Ernest R. Purser
*Assistant Examiner*—Richard E. Favreau
*Attorney, Agent, or Firm*—Guy E. Matthews

[57] ABSTRACT

A releasable stabilizer is disclosed for adjustable positioning along a drill string. The stabilizer includes a body positionable around the drill string; a coil spring mounted within the tubular body with the spring having a first and second end; anchoring apparatus mounted with the body to prevent the first end of the string from moving circumferentially around the drill string; and a rotating apparatus mounted with the body for moving the second end of the spring circumferentially around the drill string and anchoring the second end after the spring has gripped the drill string sufficiently tight to secure the body to the drill string while permitting the second end to be released when desired.

16 Claims, 6 Drawing Figures

RELEASABLE DRILL STRING STABILIZER

CROSS-REFERENCE TO RELATED APPLICATION

This application is a continuation-in-part of copending application serial No. 677,929, filed on Apr. 19, 1976, now abandoned.

BACKGROUND AND SUMMARY

It is well known in drilling oil wells, the penetration of the drill bit is influenced by the weight impinging on it. Thus, drill collars (heavy wall drill pipe) are normally made up in the bottom hole assembly to provide weight on the bit.

Also, it is well known in drilling oil wells, to use stabilizers as an aid in drilling a directional hole, as an aid in drilling a straight hole and as an aid in preventing contact between the drill string and the bore hole. Thus, stabilizers are used anywhere along the drill string above the drill bit, but mostly they are made up in the bottom hole assembly with the drill collars.

Until recently, the conventional stabilizer was a sub having fins or blades extending from a body, the body of the sub being made up in the drill string by conventional joints, such as pin and box joints. This arrangement however has several undesirable aspects: it adds tool joint connections to the drill string thereby increasing possible points of failure; it causes variations in drill collar stands which increase trip time and unsafe operation for rig personnel; it requires a special bottom hole assembly thereby increasing drilling costs; and it does not permit adjustment of the stabilizer along the drill string without changing subs thereby increasing drilling costs.

Recently, a lock-on stabilizer has been suggested to solve some of these undesirable aspects. The suggested lock-on stabilizer has a body with externally extending fins or blades, two end caps for connecting to the body, an inside solid locking ring and two outside solid locking rings with a single tapered surface for each outside ring. The stabilizer is connected to the drill string by positioning the inside locking ring inside the body, positioning an outside locking ring on either end of and with the tapered surface facing the inside locking ring. The two end caps are screwed into the body which forces the rings together and connects the stabilizer to the drill string. A major difficulty found with this arrangement is its inability to be reused after once being attached. This difficulty is caused by the inherent inability of the solid locking rings to clamp around a drill string without being deformed.

Accordingly, it is a primary object of the present invention to provide a stabilizer that is rapidly and easily connected and disconnected to a drill string by using a coil spring.

Further, it is an object of the present invention to provide a stabilizer that is rapidly and easily connected and disconnected to a drill string by using a coil spring to fasten the stabilizer to the drill string which aids in absorbing shock and vibrations.

Further, it is an object of the present invention to provide a stabilizer that is simple and inexpensive to construct while permitting releasable connection to a drill string.

Further, it is an object of the present invention to provide a stabilizer which may be added to a drill string without increasing tool joint connections.

Further, it is an object of the present invention to provide a stabilizer which may be removed from the drill string and reused without expensive repairs to the stabilizer.

In accordance with the present invention, a stabilizer is provided which is detachably connected or releasably positioned on a drill string. The stabilizer incorporates a tubular body positionable around the drill string. A coil string having a first and a second end is mounted within the body and around the drill string. An anchoring mechanism is mounted with the body for preventing circumferential movement of the first end of the spring around the drill string and a rotating apparatus is mounted with the body for moving the second end of the spring circumferentially around the drill string. The second end of the spring being releasably anchored by the rotating apparatus relative to the body after the spring has gripped the drill string sufficiently tight to secure the body to the drill string while permitting the second end to be released when desired.

BRIEF DESCRIPTION OF THE DRAWINGS

Other objects and advantages of the invention will become apparent upon reading the following detailed description and upon reference to the drawings, in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
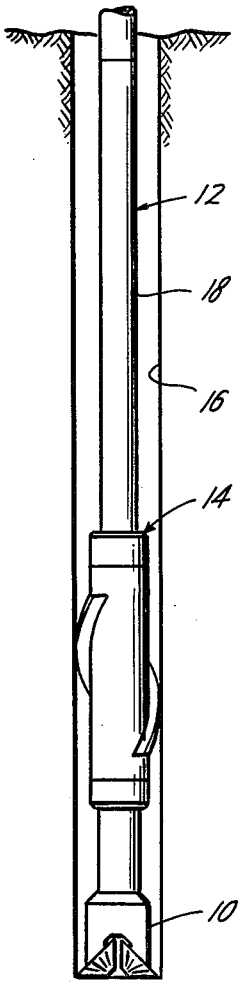
FIG. 1 is an elevational view of a stabilizer constructed according to the present invention releasably connected to a drill string within a bore hole.

Turning first to FIG. 1, there is illustrated a drill bit 10 made up within a drill string 12 having a stabilizer 14 releasably positioned thereon. A bore hole 16 is drilled by bit 10 when rotating drill string 12 in the conventional clockwise direction. Drill string 12 may be made up with one or more drill collars 18 above drill bit 10 and bore hole 16 may be lined with a casing (not shown). Although stabilizer 14 is positionable where needed along string 12, it is preferred that stabilizer 14 be releasably positioned on drill collar 18 above drill bit 10.

Figure 2:
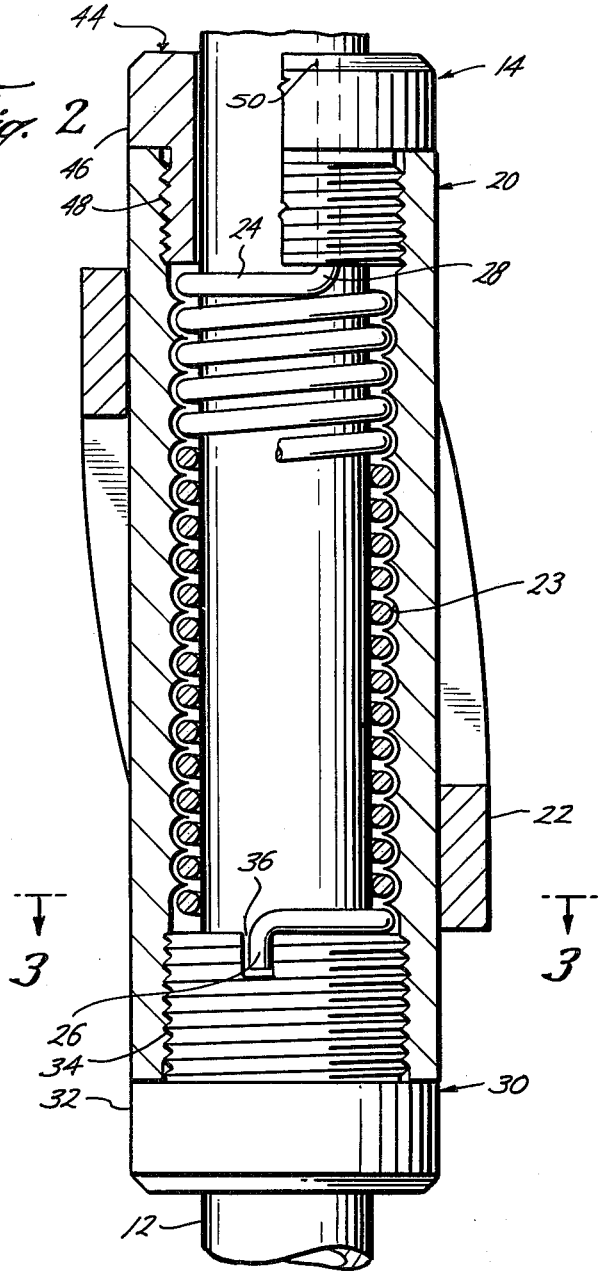
FIG. 2 is an enlarged elevational view, partly in section, of an embodiment of a stabilizer constructed according to the present invention.
Figure 3:
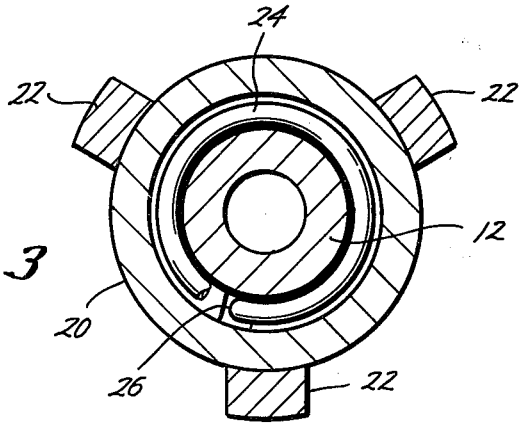
FIG. 3 is a plan view taken along lines 3—3 of the embodiment of the invention illustrated in FIG. 2.

The embodiment of the invention shown in FIGS. 2 and 3, has a tubular body 20 positionable around drill string 12. Preferably, body 20 is elongate and has blades or fins 22 disposed on the exterior to contact the walls of bore hole 16 and aid in centering bit 10 within the bore hole. The blades may be of any conventional design, however, a set of three with helical spirals are preferred. Also, a channel 23 may be provided in the interior surface of the body 20 to support a spring 24 therein which restricts movement of the spring longitudinally of drill string 10 when attaching stabilizer 14 thereto.

Spring 24 is a coil spring mounted within tubular body 20 and positionable around drill string 12 and has a first end 26 and a second end 28. Preferably, spring 24 is a multiturn coil spring and when positioned inside body 20, first end 26 is the lower end and second end 28 is the upper end. Spring 24 may be formed from round coil spring stock which has a tab extending from first end 26 and a tab extending from second end 28. The tabs for the first and second ends are substantially parallel to the tubular axis of drill string 12 and body 20 and are directed away from each other, the tab of second end 28 being longer than the tab of first end 26.

First means 30 is mounted with body 20 to anchor and prevent first end 26 of spring 24 from moving circumferentially around drill string 10. Preferably, anchoring means 30 is a tubular bolt having a passageway extending from a head 32 through a male extention for positioning around drill string 12. Male threads 34 are provided around the male extension for mating engagement within body 20 and a recess or receptacle 36 is provided in the end of the male extension. Threads 34 engage matching threads disposed within body 20 to draw head 32 against a shoulder provided on body 20 and position recess 36 within body 20 to receive and anchor the tabular extension of first end 26, as shown in FIG. 2.

Second means 44 is mounted with body 20 to move second end 28 of spring 24 circumferentially around drill string 12. Rotating means 44 is constructed to releasably secure second end 28 relative to body 20 after spring 24 has gripped drill string 12 sufficiently tight to secure the body to the drill string while permitting second end 28 to be released when desired to thereby permit adjustment of stabilizer 14 along drill string 12 or removal of the stabilizer for reuse. Preferably, rotating means 44 is a tubular bolt having a passageway extending from a head 46 through a male extension for positioning around drill string 12. Male threads 48 are provided around the male extension and a hole 50 is provided to extend longitudinally through the bolt and parallel to the passageway. Threads 48 engage matching threads disposed on body 20 to draw head 46 against a shoulder provided on the body. The tab extending from second end 28 of spring 24 is sufficiently long to pass completely through hole 50 and rotate second end 28 relative to first end 26. Thus, stabilizer 14 is releasably mounted to drill string 12 by rotating second end 28 of spring 24 relative to first end 26 which causes spring 24 to react in channel 23 to constrict and grip the drill string.

To mount stabilizer 14 to drill string 12, the location where stabilizer 14 is to be mounted is determined. Body 20, drill string 24, anchoring means 30 and rotating means 44 are positioned around drill string 12. Anchoring means 30 is threadably attached to body 20 at the location on the drill string with tubular extension of first end 26 of each spring 24 being disposed in recess 36. Second end 28 is then inserted into hole 50 and tubular bolt threadably attached to body 20 which rotates second end 28 relative to first end 26 for tightening spring 24 around drill string 12. Second end 28 is then fixed relative to string 12 by friction when rotating means 44 is joined to body 20.

In use, however, there is a danger that vibration and impact of stabilizer 14 against material within bore hole 16 will cause unintended rotation of anchoring means 30 and rotating means 44 relative to body 20. This relative rotation might cause stabilizer 14 to release from drill string 12. To solve this potential detriment, stabilizer 14 may be installed with anchoring means 30 positioned on the lower end of body 20 and a left hand set of threads 48 be provided on the bolt of rotating means 44. Thus, since drill bit 10 is turned clockwise by drill string 12, the provision of left hand threads on the upper end of stabilizer 14 will cause the bolt of rotating means 44 to tighten during drilling operations.

Figure 6:
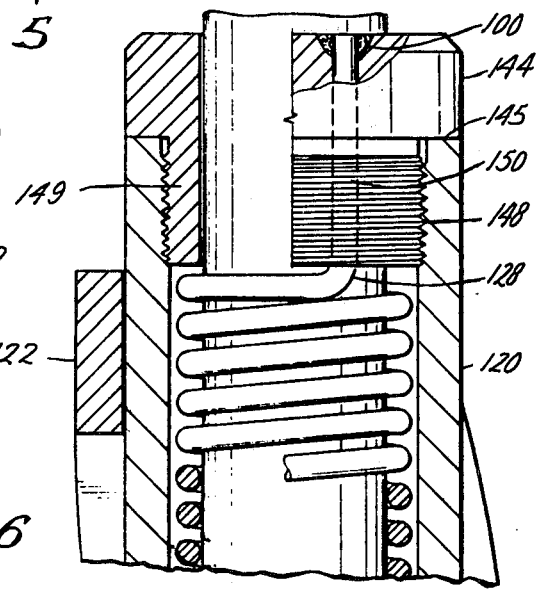
FIG. 6 is an elevational view, partly in section, of a rotating apparatus useable in a third embodiment of a stabilizer constructed according to the present invention.

As shown in FIG. 6, another embodiment of the invention is illustrated. This embodiment is basically the same as the embodiment illustrated in FIGS. 2 and 3. The major difference involves the method and apparatus to prevent spring 24 from moving longitudinally in body 20. This difference includes providing a rotating means 144 having a tubular bolt which has a head 144, male threads 148 provided on the male extension and a hole 150 extending longitudinally through the bolt. Threads 148 engage matching threads disposed on body 20 to draw head 144 against a shoulder 145 provided on body 20. As shown, spring 24 has a tabular extension on second end 128 for extending through the hole 150 similar to that explained with respect to the embodiment shown in FIG. 2. However, body 120 does not have a channel formed in the interior surface. Thus, second end 128 of spring 24 is welded, such as at 100, within aperture 150 to prevent longitudinal movement of spring 24 when mounting stabilizer 14 to drill string 12.

Figure 4:
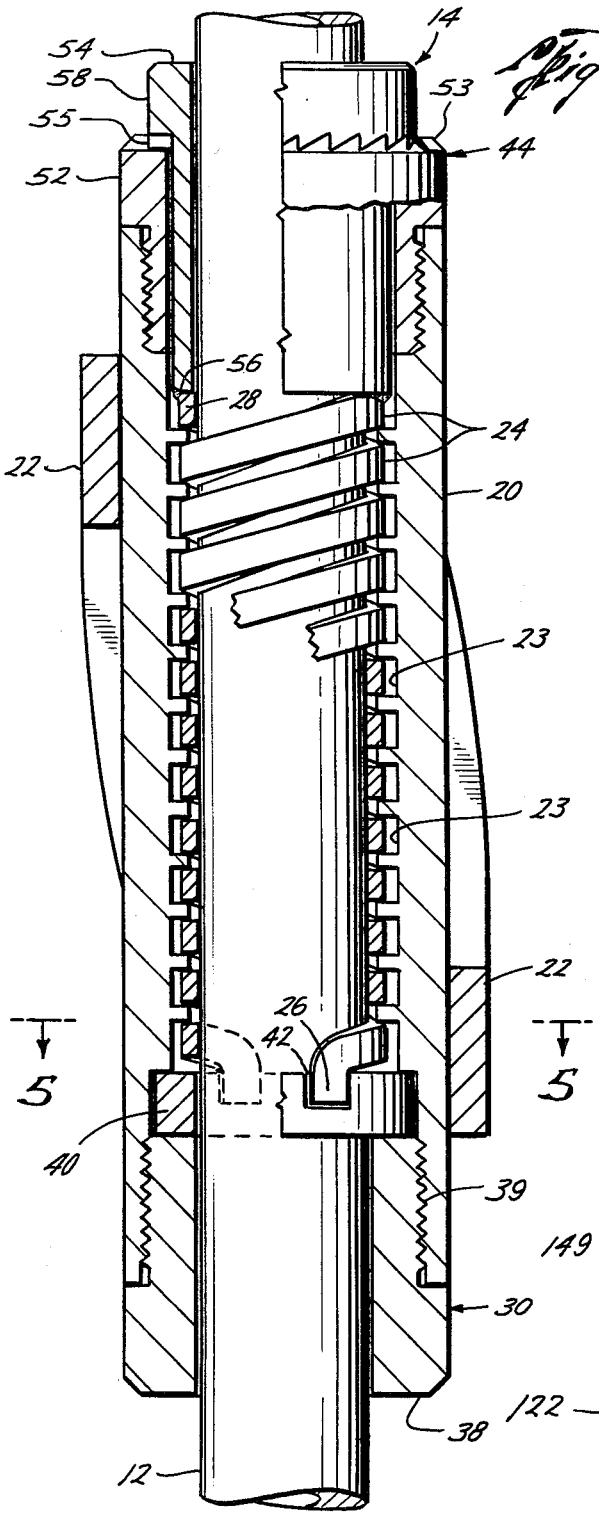
FIG. 4 is an elevational view, partly in section, of a second embodiment of a stabilizer constructed according to the present invention.
Figure 5:
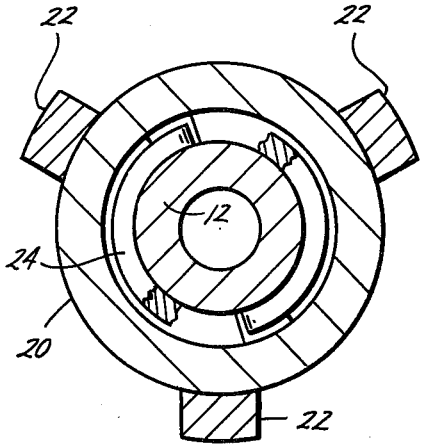
FIG. 5 is a plan view taken along lines 5—5 of the invention illustrated in FIG. 4.

As shown in FIGS. 4 and 5, another embodiment of the invention is illustrated. This embodiment however includes two coil springs 24 used to mount stabilizer 14 to drill string 12 with each spring being wound in a common helix around drill string 12. Springs 24 are formed from flat spring stock with a flat face contacting the drill string 12 to provide a better frictional grip than that obtainable by springs of round spring stock. A tab extends from first end 26 longitudinally of the axis of drill string 12 and body 20, but no tab extends from second end 28.

Anchoring means 30 prevents first end 26 of each spring from moving circumferentially around drill string 12 by using a generally tubular bolt having a head 38 and male threads 39 provided around the male extension. Threads 39 engage matching threads disposed within body 20 to fix a ring 40 relative to body 20. Ring 40 has a recess or receptacle 42 for receiving the tabular extension from first end 26 of each spring 24.

Rotating means 44 of this embodiment includes an externally threaded tubular cap or bolt 52 and a tubular sleeve or bolt 54. Cap 52 threadably engages body 20 and has a shoulder 53 defining a sawtooth shaped surface pattern repeated about the circumference thereof. Tubular sleeve 54 is positionable around drill string 12, has a first end 54 concentrically received in cap 52 and is attached to second end 28 of each string 24, such as by welding, and has a second end forming a shoulder 55 which defines a sawtooth shaped surface pattern for matching the pattern on shoulder 53 of cap 52. The abutting surfaces of cap 52 and sleeve 54 form matching sawtoothed surfaces that define a ratchet mechanism to permit movement of second end 28 in a tightening direction while restricting movement in the opposite direction.

To mount the embodiment of the invention shown in FIGS. 4 and 5 to drill string 12, the operation is similar to that described in relation to the embodiment shown in FIGS. 2 and 3. However, ring 40 is positioned around drill string 12 and then the bolt of anchoring means 30 is threadably attached to body 20. Tubular cap 52 is then threadably joined to body 20 and sleeve 54 with each spring 24 attached thereto slid into body 20 and rotated about spring 12 until the tubular extension of each first end 26 engages a recess 42 of ring 40. Sleeve 54 is continued to be rotated in a tightening direction about string 12 until stabilizer 14 is fixed to string 12. Stabilizer 14 is detached from string 12 by simply reversing these steps.

Thus, it is apparent that there has been provided, in accordance with the invention, a stabilizer for releasable mounting to a drill string that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations that fall within the spirit and broad scope of the appended claims.

What is claimed is:

1. A stabilizer adapted to be releasably positioned on a drill collar for use in a drill string positioned in a well bore and above a drill bit which comprises:

an elongate tubular body;

spring means having upper and lower ends, connected to said tubular body;

first means for anchoring one end of said spring means with the drill collar;

second means for anchoring the remaining end of said spring means after said spring means has been wound around the drill collar on which the stabilizer is to be positioned sufficiently tight to functionally grip the drill collar thereby fixedly and releasably positioning and connecting said tubular body to the drill collar.

2. The apparatus of claim 1 wherein one of said anchoring members comprises a tubular bolt which is threaded into said tubular body and includes means for connecting to the end of said coil spring adjacent thereto.

3. A stabilizer adapted to be releasably positioned on a drill collar for use in a drill string positioned in a well bore and above a drill bit which comprises:

an elongate tubular body having a set of helical threads on the exterior;

a multiturn coil spring positioned inside said tubular body having upper and lower ends thereof;

first means for anchoring one end of the coil spring;

second means for anchoring the remaining end of said spring after said spring has been wound around the drill collar on which the stabilizer is to be positioned sufficiently right to frictionally grip the drill collar and including a first tubular bolt nut which threads into said tubular body, and a second tubular bolt concentrically received in said first bolt, said first and second bolts having abutting end located shoulders and said spring is connected to the second bolt, and said shoulders include an irregular surface defined by angular surfaces interrupted by transverse shoulders which define a ratchet mechanism enabling said spring to tighten about the drill collar without slippage between said bolts; and said first and second means fixedly connecting said tubular body to said coil spring.

4. The apparatus of claim 3 including a means for joining the second bolt to said spring.

5. The apparatus of claim 3 wherein both of said bolts fit loosely around the drill collar and one of them is threaded into said tubular member against a shoulder limiting the position thereof.

6. The apparatus of claim 3 wherein said shoulders are circular and are parallel to one another, and have a sawtooth shaped surface pattern repeated around the circumference thereof.

7. A stabilizer for releasable mounting with a drill string, comprising:

a tubular body positionable around the drill string;

a coil spring mounted within said tubular body and positionable around the drill string, said spring having a first and second end;

anchoring means mounted with said body for preventing the circumferential movement of the first end of said spring around the drill string; and rotating means mounted with said body for moving the second end of said spring circumferentially around the drill string and anchoring the second end after said spring has gripped the drill string sufficiently tight to secure the body to the drill string while permitting the second end to be released when desired.

8. The apparatus of claim 7, wherein said coil spring is formed from round spring stock.

9. The apparatus of claim 7, wherein said coil spring is formed from flat spring stock with a face used to contact the drill string.

10. The apparatus of claim 7, wherein the first end of said spring has a tabular extension and said anchoring means has a recess therein for receiving the extension.

11. The apparatus of claim 7, wherein the second end of said spring is welded to said rotating means.

12. The apparatus of claim 7, wherein the second end of said spring has a tabular extension and said rotating means has a hole therein for receiving the extension.

13. The apparatus of claim 7, wherein said body has a blade disposed on the exterior of said body to prevent contact between said body and a bore hole.

14. The apparatus of claim 7, including at least two coil springs being mounted within said body and around the drilling spring, each said spring having first and second ends and being wound in a common cylinder; and wherein said anchoring means is adapted to prevent the first end of each spring from moving circumferentially around the drill string; and wherein said rotating means is adapted for moving the second end of each spring circumferentially around the drill string and anchoring the second end of each spring after the spring has gripped the drill string sufficiently tight to secure the body to the drill string.

15. The apparatus of claim 7, wherein said body has a channel provided in the interior surface to support said spring therein for restricting movement of said spring longitudinally of the drill string when mounting the stabilizer thereto.

16. The apparatus of claim 7, wherein said rotating means includes a tubular cap threadably mounted with said body, said cap having a shoulder defining a sawtooth shaped surface pattern repeated around the circumference thereof, a tubular sleeve mounted with the second end of said spring for concentric reception within the cap, said sleeve having a shoulder defining a sawtooth shaped surface pattern for matching the shoulder of said cap to provide a ratchet mechanism in said rotating means to thereby permit movement of the second end of said spring in a tightening direction while restricting movement in an opposite direction.

* * * * *